US009883761B2

(12) United States Patent
Johnson-Lewis

(10) Patent No.: US 9,883,761 B2
(45) Date of Patent: Feb. 6, 2018

(54) ROTARY FOOD SERVER ASSEMBLY

(71) Applicant: Sonja Johnson-Lewis, Inglewood, CA (US)

(72) Inventor: Sonja Johnson-Lewis, Inglewood, CA (US)

( * ) Notice: Subject to any disclaimer, the term of this patent is extended or adjusted under 35 U.S.C. 154(b) by 323 days.

(21) Appl. No.: 14/706,674

(22) Filed: May 7, 2015

(65) Prior Publication Data

US 2016/0324352 A1 Nov. 10, 2016

(51) Int. Cl.
*G05B 19/00* (2006.01)
*A47G 23/08* (2006.01)
*A47F 10/06* (2006.01)

(52) U.S. Cl.
CPC ..... *A47G 23/08* (2013.01); *A47F 10/06* (2013.01)

(58) Field of Classification Search
CPC ..... A47J 37/0781; A47B 5/00
See application file for complete search history.

(56) References Cited

U.S. PATENT DOCUMENTS

D160,688 S 10/1950 Brock
3,972,419 A 8/1976 Short
4,237,796 A * 12/1980 Gordon ..... A61B 3/18 108/103
D260,343 S 8/1981 Blake et al.
5,003,159 A 3/1991 Thorson
5,323,695 A * 6/1994 Borgman ..... A47B 9/00 108/147
5,421,271 A * 6/1995 Sui ..... A47B 11/00 108/20
5,676,360 A * 10/1997 Boucher ..... B23Q 1/52 269/57
5,937,764 A * 8/1999 Olivier ..... A47B 11/00 108/20
5,950,503 A * 9/1999 Amendolea ..... B23P 21/006 74/813 C
7,007,813 B2 3/2006 Yang
7,225,633 B2 6/2007 DeMars
2009/0057252 A1 3/2009 Eckenrode et al.
2009/0126639 A1* 5/2009 Hsieh ..... A01K 5/0225 119/51.11
2015/0015104 A1* 1/2015 Kataoka ..... H02K 7/06 310/80

* cited by examiner

*Primary Examiner* — Vincent Tran

(57) ABSTRACT

A rotary food server assembly for rotatably serving a selected food item includes a bottom disk that may be positioned on a support surface. An upper disk is movably coupled to the bottom disk so the upper disk may support a food item. A processor is coupled to the bottom disk. An actuator is coupled to the bottom disk. The actuator is operationally coupled to the processor so the processor may selectively actuate the actuator. The actuator is operationally coupled to the upper disk so the actuator may selectively move the upper disk. A keypad is coupled to the bottom disk so a user may touch the keypad. The keypad is operationally coupled to the processor so the actuator may move the upper disk to a selected position.

13 Claims, 4 Drawing Sheets

ROTARY FOOD SERVER ASSEMBLY

BACKGROUND OF THE DISCLOSURE

Field of the Disclosure

The disclosure relates to rotary food server devices and more particularly pertains to a new rotary food server device for rotatably serving a selected food item.

SUMMARY OF THE DISCLOSURE

An embodiment of the disclosure meets the needs presented above by generally comprising a bottom disk that may be positioned on a support surface. An upper disk is movably coupled to the bottom disk so the upper disk may support a food item. A processor is coupled to the bottom disk. An actuator is coupled to the bottom disk. The actuator is operationally coupled to the processor so the processor may selectively actuate the actuator. The actuator is operationally coupled to the upper disk so the actuator may selectively move the upper disk. A keypad is coupled to the bottom disk so a user may touch the keypad. The keypad is operationally coupled to the processor so the actuator may move the upper disk to a selected position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
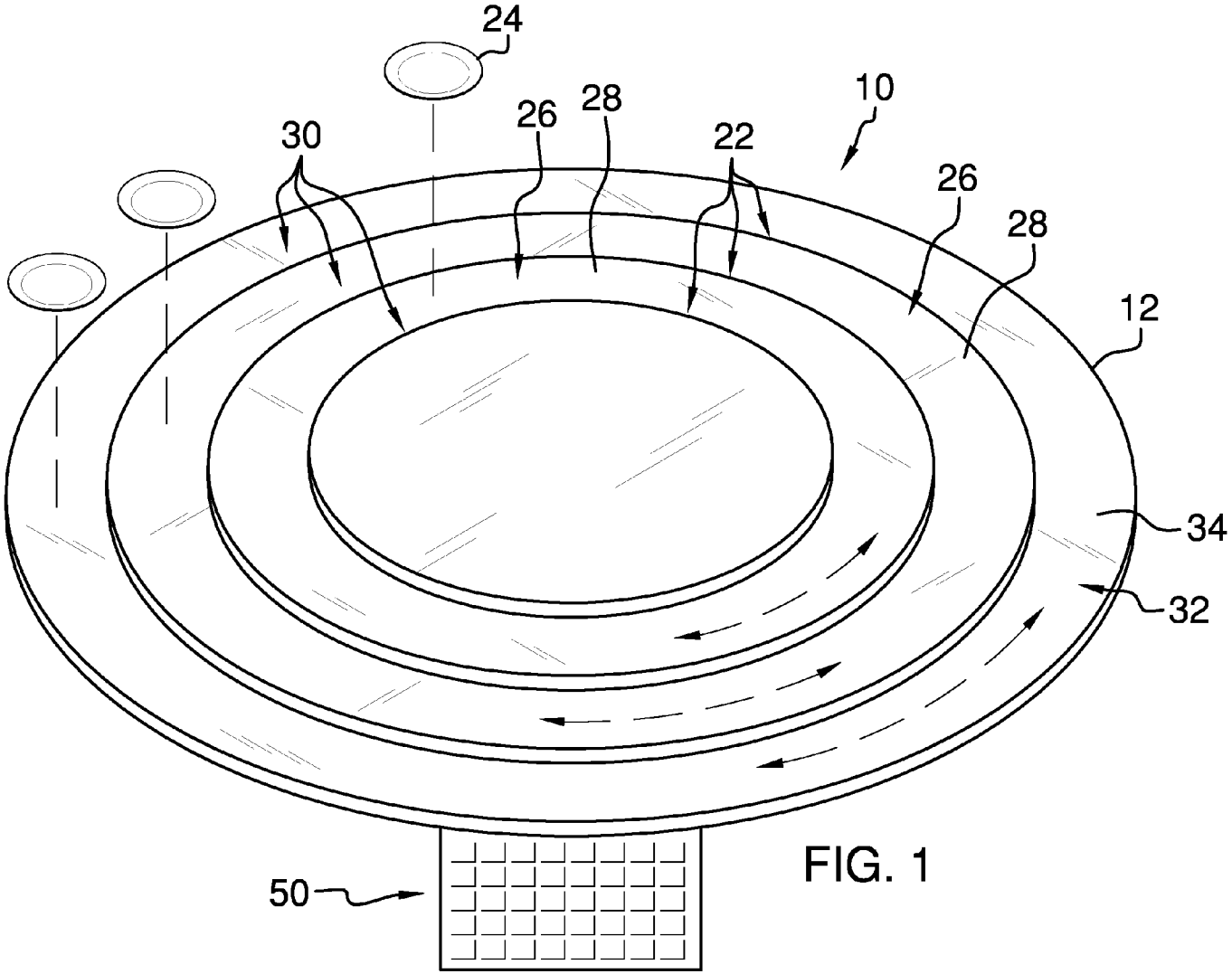
FIG. 1 is a perspective view of a rotary food server assembly according to an embodiment of the disclosure.
Figure 2:
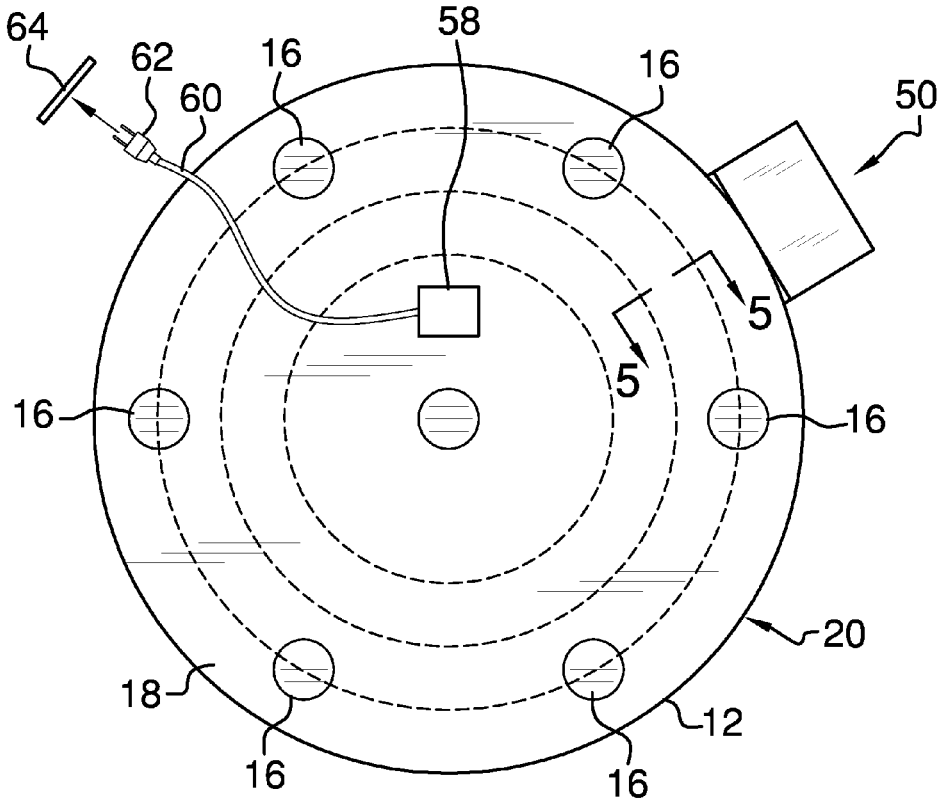
FIG. 2 is a bottom view of an embodiment of the disclosure.
Figure 3:
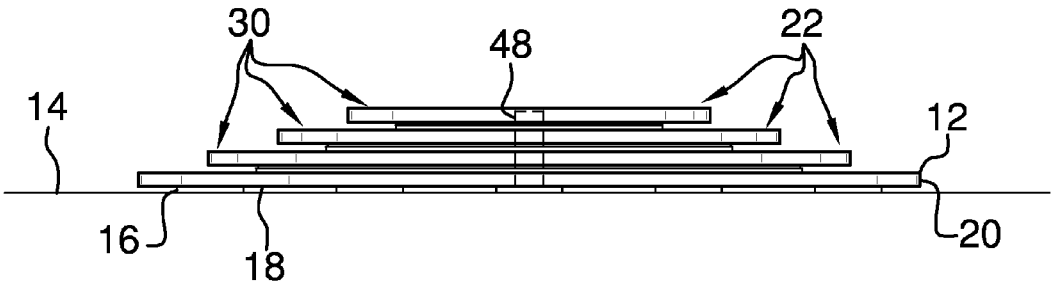
FIG. 3 is a right side view of an embodiment of the disclosure.
Figure 4:
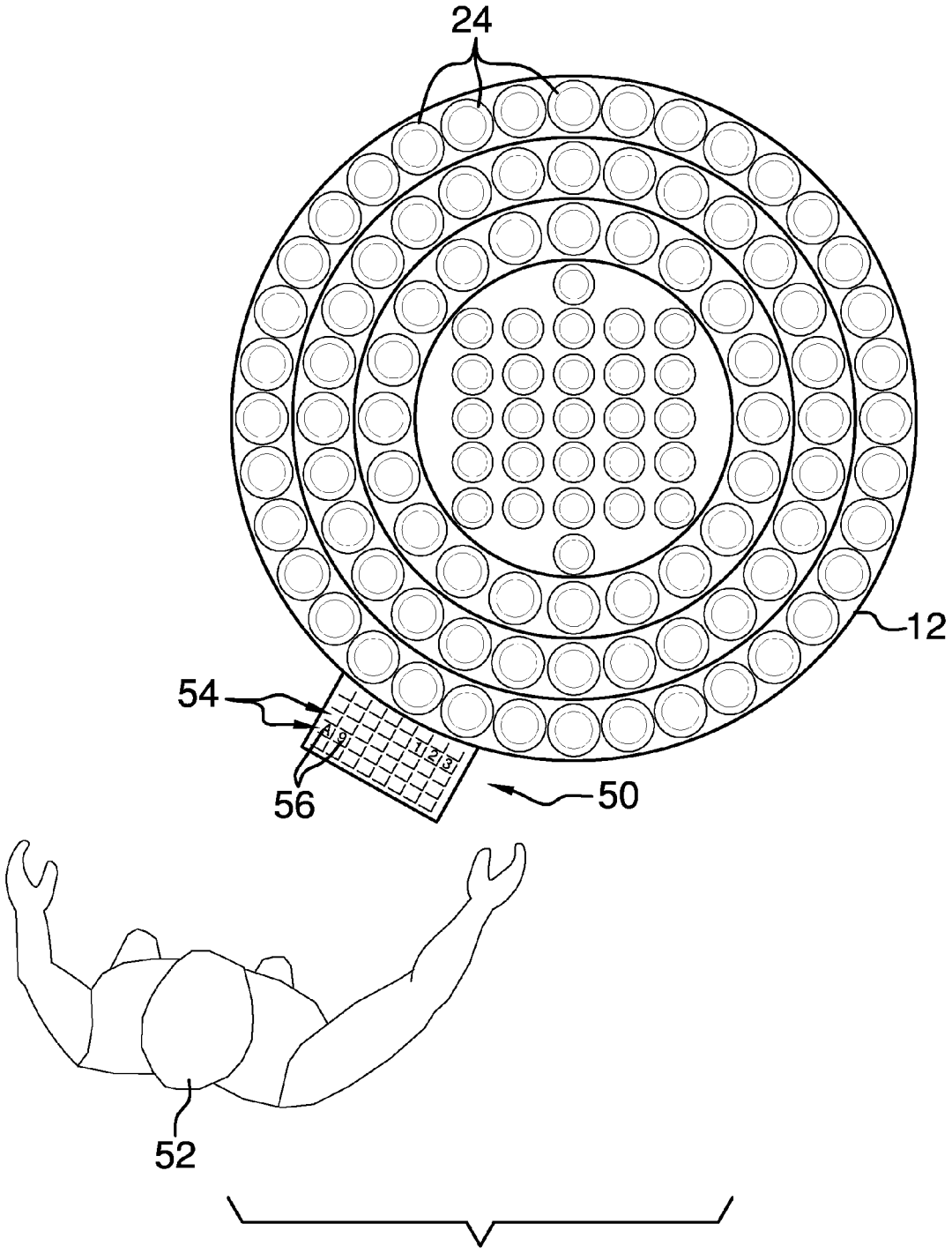
FIG. 4 is a top view of an embodiment of the disclosure.
Figure 5:
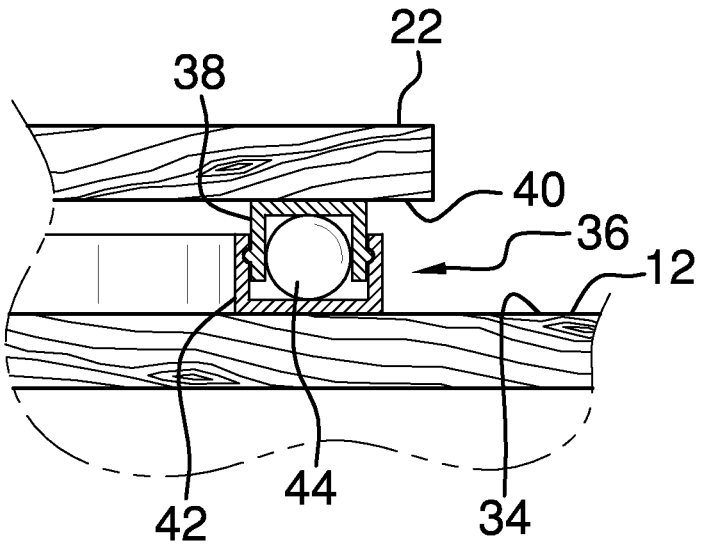
FIG. 5 is a cross sectional view taken along line 5-5 of FIG. 2 of an embodiment of the disclosure.
Figure 6:
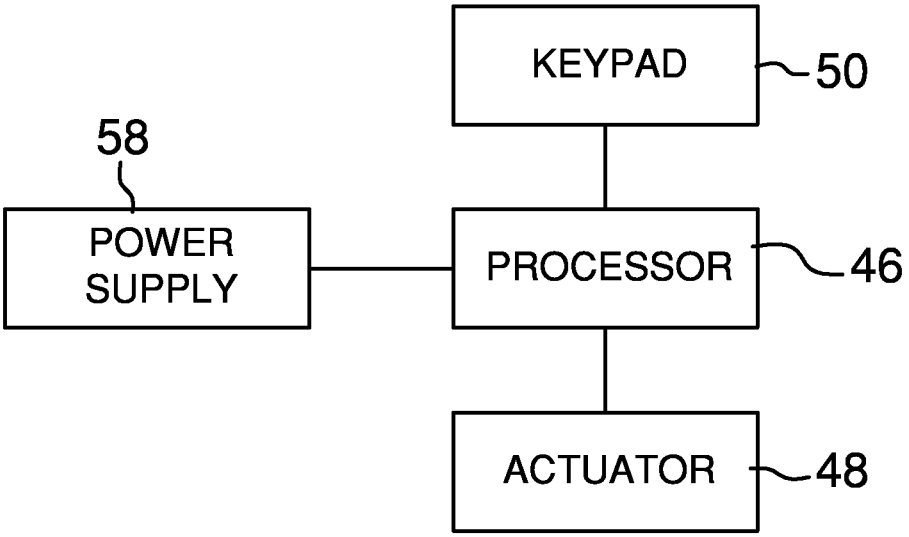
FIG. 6 is a schematic view of an embodiment of the disclosure.

With reference now to the drawings, and in particular to FIGS. 1 through 6 thereof, a new rotary food server device embodying the principles and concepts of an embodiment of the disclosure and generally designated by the reference numeral 10 will be described.

As best illustrated in FIGS. 1 through 6, the rotary food server assembly 10 generally comprises a bottom disk 12 that may be positioned on a support surface 14. The bottom disk 12 may have a diameter between 1 m and 2 m. A foot 16 is coupled to a bottom 18 of the bottom disk 12 proximate an outer edge 20 of the bottom disk 12. In addition, the foot 16 abuts the support surface 14 so the foot 16 supports the bottom disk 12 above the support surface 14. The support surface 14 may be a table. Continuing, the foot 16 is one of a plurality of the feet 16 that is evenly distributed around a perimeter of the bottom 18 of the bottom disk 12.

An upper disk 22 is provided that has a diameter that is less than a diameter of the bottom disk 12. The upper disk 22 forms a concentric circle with respect to the bottom disk 12. Additionally, the upper disk 22 is movably coupled to the bottom disk 12 so the upper disk 22 may support a food item 24. The food item 24 may be one of a plurality of food items 24 evenly distributed around an exposed portion 26 of a top 28 of the upper disk 22.

The upper disk 22 is one of a plurality of vertically stacked upper disks 30 that is each movably coupled to one another. The plurality of vertically stacked upper disks 30 each has a diameter that is less than a lower one of the vertically stacked upper disks 30. In addition, the plurality of vertically stacked upper disks 30 forms a plurality of concentric circles with respect to the bottom disk 12. Continuing, the plurality of food items 24 may each be positioned upon and evenly distributed around an exposed portion 26 of the top 28 of each of the plurality of vertically stacked upper disks 30 and an exposed portion 32 of a top 34 of the bottom disk 12. The plurality of vertically stacked upper disks 30 may each have a diameter ranging between 1 m and 50 cm.

A bearing track 36 is coupled between the upper 22 and bottom 12 disks so the upper disk 22 is rotatably coupled to the bottom disk 12. The bearing track 36 forms a closed loop so the bearing track 36 has a diameter that is less than a diameter of the upper disk 22. Additionally, the bearing track 36 comprises a top portion 38 of the bearing track 36 coupled to a bottom 40 of the upper disk 22 and a bottom portion 42 of the bearing track 36 coupled to the top 34 of the bottom disk 12. The bottom portion 42 of the bearing track 36 insertably receives the top portion 38 of the bearing track 36.

A plurality of ball bearings 44 is positioned between each of the top 38 and bottom 40 portions of the bearing track 36. The ball bearings 44 reduce a rotational friction of the bearing track 36. Continuing, the bearing track 36 is one of a plurality of bearing tracks 36 each coupled between each of an associated one of a plurality of vertically stacked upper disks 30. The plurality of bearing tracks 36 each has a diameter that is less than a diameter of a lower one of the plurality of bearing tracks 36.

A processor 46 is coupled to the bottom disk 12. An actuator 48 is coupled to the bottom disk 12. The actuator 48 is electrically coupled to the processor 46 so the processor 46 may selectively actuate the actuator 48. Continuing, the actuator 48 is mechanically coupled to each of the plurality of vertically stacked upper disks 30 so the actuator 48 may selectively rotate a selected one of the plurality of vertically stacked upper disks 30. The actuator 48 may comprise an electric actuator of any conventional design.

A keypad 50 is coupled to and extends laterally away from the outer edge 20 of the bottom disk 12 so a user 52 may touch the keypad 50. The keypad 50 comprises a plurality of keys 54 and each of the plurality of keys 54 is labeled with a corresponding one of a plurality of alpha-numeric characters 56. The keypad 50 is electrically coupled to the processor 46 so the actuator 48 rotates a selected one of the plurality of vertically stacked upper disks 30 to a selected position.

A power supply 58 is coupled to the bottom disk 12. The power supply 58 is electrically coupled to the processor 46. Additionally, the power supply 58 comprises a power cord 60. A free end 62 of the power cord 60 may be selectively electrically coupled to a power source 64. The power source 64 may comprise a female electrical outlet.

In use, the user 52 actuates a selected one of the plurality of keys 54 on the keypad 50. The selected alpha-numeric characters 56 on the keys 54 corresponds to a selected one of the plurality of food items 24. In addition, the processor 46 actuates the actuator 48 to rotate the selected one of the plurality of vertically stacked upper disks 30. The selected one of the vertically stacked upper disks 30 is rotated until the selected foot item 24 is positioned proximate the keypad 50. Continuing, the user 52 removes the selected food item 24 from the associated one of the plurality of vertically stacked disks 30 or the bottom disk 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A rotary food server assembly for automatically serving a selected food item, said assembly comprising:

a bottom disk configured to be positioned on a support surface;

an upper disk movably coupled to said bottom disk wherein said upper disk supports a food item, said upper disk having a diameter being less than a diameter of said bottom disk wherein said upper disk forms a concentric circle with respect to said bottom disk;

a bearing track coupled between said upper and bottom disks wherein said upper disk is rotatably coupled to said bottom disk;

a processor coupled to said bottom disk;

an actuator coupled to said bottom disk, said actuator being operationally coupled to said processor wherein said processor selectively actuates said actuator, said actuator being operationally coupled to said upper disk wherein said actuator selectively moves said upper disk; and a keypad coupled to said bottom disk, said keypad being operationally coupled to said processor wherein said actuator moves said upper disk to a selected position upon manipulation of said keypad, said keypad comprising a plurality of keys labeled with corresponding alphanumeric characters, said keypad being coupled to and extending laterally away from an outer edge of said bottom disk.

2. The assembly according to claim 1, further comprising a foot coupled to a bottom of said bottom disk proximate an outer edge of said bottom disk wherein said foot abuts the support surface wherein said foot supports said bottom disk above the support surface.

3. The assembly according to claim 2, further comprising said foot being one of a plurality of said feet being evenly distributed around a perimeter of said bottom of said bottom disk.

4. The assembly according to claim 1, further comprising said bearing track forming a closed loop wherein said bearing track has a diameter being less than a diameter of said upper disk.

5. The assembly according to claim 4, further comprising said bearing track comprising a top portion of said bearing track coupled to a bottom of said upper disk and a bottom portion of said bearing track coupled to a top of said bottom disk.

6. The assembly according to claim 1, further comprising said upper disk being one of a plurality of vertically stacked upper disks each being movably coupled to one another.

7. The assembly according to claim 6, further comprising said plurality of vertically stacked upper disks each having a diameter being less than a lower one of said vertically stacked upper disks wherein said plurality of vertically stacked upper disks forms a plurality of concentric circles with respect to said bottom disk.

8. The assembly according to claim 1, further comprising said bearing track being one of a plurality of said bearing tracks each coupled between each of an associated one of a plurality of vertically stacked upper disks.

9. The assembly according to claim 8, further comprising said plurality of bearing tracks each having a diameter being less than a diameter of a lower one of said plurality of bearing tracks.

10. The assembly according to claim 1, further comprising said actuator being mechanically coupled to each of a plurality of vertically stacked upper disks wherein said actuator selectively rotates a selected one of said plurality of vertically stacked upper disks.

11. The assembly according to claim 1, further comprising said keypad being electrically coupled to said processor.

12. The assembly according to claim 1, further comprising:

a power supply coupled to said bottom disk;

said power supply being electrically coupled to said processor; and said power supply comprising a power cord being selectively electrically coupled to a power source.

13. A rotary food server assembly for automatically serving a selected food item, said assembly comprising:

a bottom disk configured to be positioned on a support surface;

a foot coupled to a bottom of said bottom disk proximate an outer edge of said bottom disk wherein said foot abuts the support surface wherein said foot supports said bottom disk above the support surface, said foot being one of a plurality of said feet being evenly distributed around a perimeter of said bottom of said bottom disk;

an upper disk having a diameter being less than a diameter of said bottom disk wherein said upper disk forms a concentric circle with respect to said bottom disk, said upper disk being movably coupled to said bottom disk wherein said upper disk supports a food item, said upper disk being one of a plurality of vertically stacked upper disks each being movably coupled to one another, said plurality of vertically stacked upper disks each having a diameter being less than a lower one of said vertically stacked upper disks wherein said plurality of vertically stacked upper disks forms a plurality of concentric circles with respect to said bottom disk;

a bearing track coupled between said upper and bottom disks wherein said upper disk is rotatably coupled to said bottom disk, said bearing track forming a closed loop wherein said bearing track has a diameter being less than a diameter of said upper disk, said bearing track comprising a top portion of said bearing track coupled to a bottom of said upper disk and a bottom portion of said bearing track coupled to a top of said bottom disk, said bearing track being one of a plurality of said bearing tracks each coupled between each of an associated one of a plurality of vertically stacked upper disks, said plurality of bearing tracks each having a diameter being less than a diameter of a lower one of said plurality of bearing tracks;

a processor coupled to said bottom disk;

an actuator coupled to said bottom disk, said actuator being electrically coupled to said processor wherein said processor selectively actuates said actuator, said actuator being mechanically coupled to each of said plurality of vertically stacked upper disks wherein said actuator selectively rotates a selected one of said plurality of vertically stacked upper disks, a keypad coupled to and extending laterally away from said outer edge of said bottom disk, said keypad comprising a plurality of keys labeled with corresponding alphanumeric characters, said keypad being electrically coupled to said processor wherein said actuator rotates a selected one of said plurality of vertically stacked upper disks to a selected position upon manipulation of said keypad; and a power supply coupled to said bottom disk, said power supply being electrically coupled to said processor, said power supply comprising a power cord being selectively electrically coupled to a power source.

* * * * *